United States Patent [19]

Giles

[11] 4,130,373

[45] Dec. 19, 1978

[54] EROSION SUPPRESSION FOR LIQUID-COOLED GAS TURBINES

[75] Inventor: Walter B. Giles, Scotia, N.Y.

[73] Assignee: General Electric Company, Schenectady, N.Y.

[21] Appl. No.: 741,615

[22] Filed: Nov. 15, 1976

[51] Int. Cl.[2] ..... F01D 5/18

[52] U.S. Cl. ..... 415/1; 415/116; 415/168; 416/96 R

[58] Field of Search ..... 415/115, 116, 168; 416/97, 96, 96 R, 97 R; 60/265

[56] References Cited

U.S. PATENT DOCUMENTS

| | | | |
|---|---|---|---|
| 3,736,071 | 5/1973 | Kydd | 415/168 X |
| 3,804,551 | 4/1974 | Moore | 416/97 |
| 3,816,022 | 6/1974 | Day | 416/97 X |

FOREIGN PATENT DOCUMENTS

| | | | |
|---|---|---|---|
| 807705 | 1/1937 | France | 415/168 |
| 461600 | 2/1937 | United Kingdom | 415/168 |

*Primary Examiner*—Albert W. Davis, Jr.
*Attorney, Agent, or Firm*—Nathan D. Herkamp; Joseph T. Cohen; Leo I. MaLossi

[57] ABSTRACT

By maintaining a circumferentially-continuous, rotating film of water on the housing of a water-cooled gas turbine, kinetic energy imparted to the cooling water droplets by rotational velocity of the turbine bucket shrouds is partially absorbed in the film when struck by the droplets, thereby reducing erosive effects on the turbine housing resulting from droplets slamming the housing.

8 Claims, 6 Drawing Figures

EROSION SUPPRESSION FOR LIQUID-COOLED GAS TURBINES

INTRODUCTION

This invention relates to liquid-cooled gas turbines, and more particularly to a method and apparatus for reducing erosion of turbine housings caused by high kinetic energy coolant droplets impacting thereon.

In order to improve the operating characteristics of gas turbines, cooling liquid is circulated through a multitude of channels in the turbine buckets. This enables turbine inlet temperatures to be increased to an operating range of from 2500° F. to at least 3500° F., thereby achieving a power output increase ranging from about 100% to 200% and a thermal efficiency increase ranging up to 50%. Such turbines are referred to as "ultra high temperature" (UHT) gas turbines.

In UHT gas turbines, excess coolant liquid in the channels that has not been converted to steam is combined in a rearward-directed nozzle in an effort to reclaim as much kinetic energy of the liquid and steam as possible. The liquid then impacts against the turbine housing wall. In passing through the high shear gradient between the rotor and the turbine housing wall, a liquid stream forms droplets which produce very high slamming pressures, up to at least 300,000 pounds per square inch peak pressures for normal impacts resulting from 1600 feet per second droplet velocities. A glancing angle of impact tends to reduce these slamming pressures, but the impacts still act as a source of stress fatigue over the very long operational life required of the machine. It would, therefore, be desirable to reduce these slamming pressures still further and thereby abate the deleterious erosion produced by these droplets.

Accordingly, one object of the invention is to minimize erosion of gas turbine walls.

Another object of the invention is to ensure that a major portion of the kinetic energy imparted to liquid coolant droplets by rotational velocity of gas turbine bucket shroud elements is absorbed prior to the droplets striking the inner surface of the turbine housing.

Another object is to provide a circumferentially-continuous liquid coating over the inside surfaces of the housing of a gas turbine.

Briefly, in accordance with a preferred embodiment of the invention, a method of reducing erosion of the inner surface of a gas turbine housing due to slamming of droplets of liquid coolant thereagainst comprises coating the surface with a circumferentially-continuous film of liquid coolant to absorb at least a portion of the kinetic energy of the droplets, and maintaining the film between predetermined thickness limits substantially throughout normal operation of the gas turbine.

In accordance with another preferred embodiment of the invention, a gas turbine is provided having a rotor disk mounted on a shaft rotatably supported in a housing. The rotor disk extends substantially perpendicular to the axis of the shaft and has turbine buckets and platform means affixed to the outer rim thereof. The buckets receive a driving force from a hot motive fluid confined within the housing and moving in a direction generally parallel to the axis of the shaft. Liquid coolant introduced into distribution paths traverses surface area of the rim and the platform means, passes into cooling channels in the buckets, and exits from the channels in a radially-outward direction. An outlet in the turbine housing permits escape of liquid coolant from the interior of the turbine, and valve means situated in the outlet and responsive to static pressure differential between two different locations on the housing controls the rate of escape of liquid coolant so as to maintain a liquid coolant film of thickness within minimum and maximum limits about the inner surface of the turbine housing.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
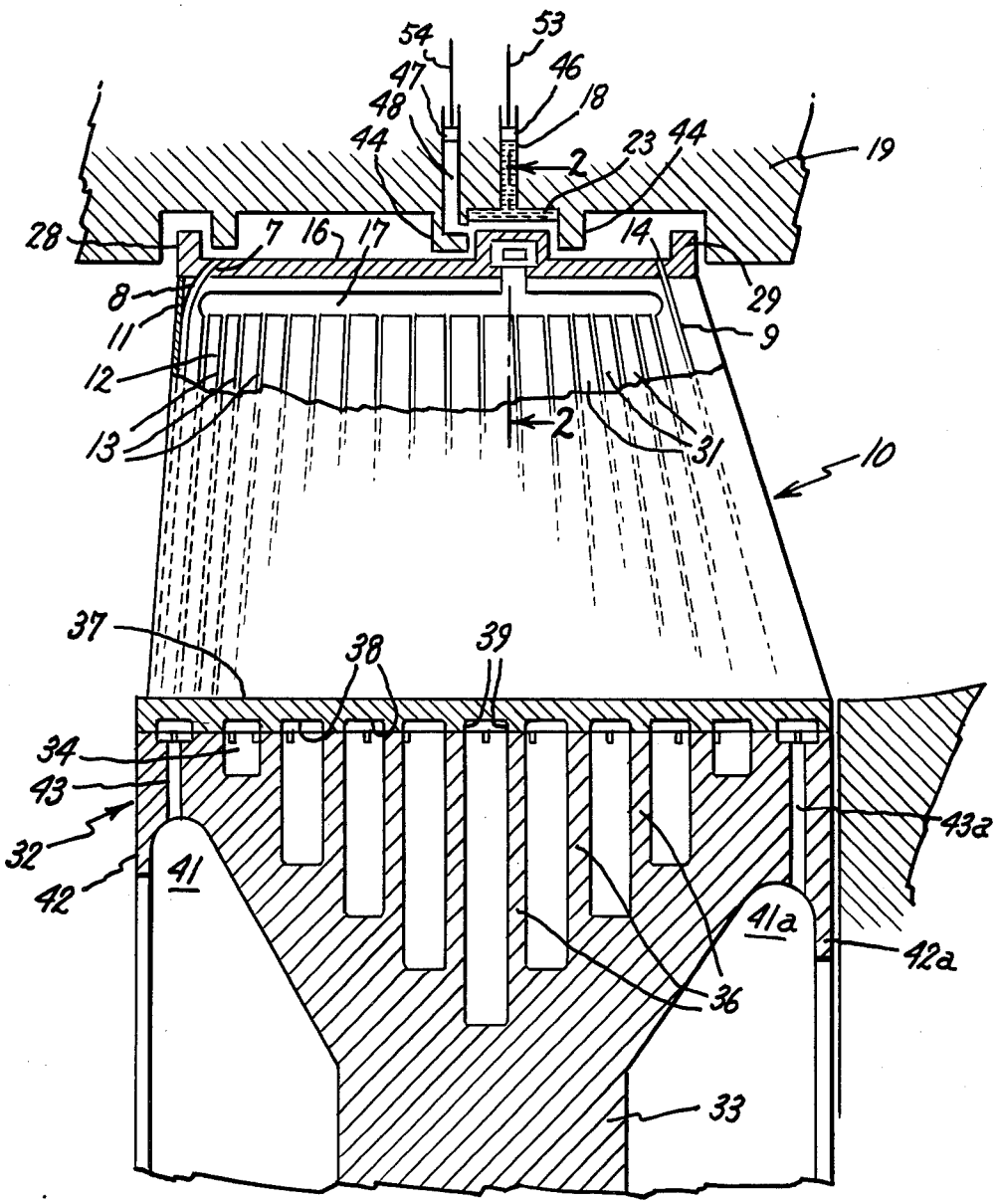
FIG. 1 is a partially broken-away transverse sectional view through a liquid-cooled gas turbine showing the rotor disk rim, a shrouded liquid-cooled turbine bucket affixed thereto, and a pressure sensing passageway in the turbine housing aligned with the turbine blade coolant flow outlet.

In FIG. 1, a turbine bucket 10 is illustrated having a metal skin 11 bonded to a hollow core 12 having spanwise-extending grooves 13 formed in the airfoil surfaces thereo. The rectangular cooling channels, or passages, defined by skin 11 and grooves 13 conduct cooling liquid therethrough at a uniform depth beneath skin 11. Cooling channels 8 and 9 in the leading edge and trailing edge, respectively, of bucket 10 close to either axial side thereof extend out to the top of the bucket and communicate with passages 7 and 14, respectively, through shroud element 16.

At their outer ends, cooling channels 13 on the pressure side of bucket 10 are in flow communication with, and terminate at, manifold 17 recessed in core 12. On the suction side of bucket 10, cooling channels 13 are in flow communication with, and terminate at, manifold **17*a* which is recessed in core 12**, as shown in FIG. 2.

Requisite open-circuit discharge of coolant from manifolds 17, **17*a* is insured by provision of discharge means 21, 21*a*, which provide flow communication for manifolds 17, 17*a* with a nozzle 26. Passageways 21, 21*a* connect to manifolds 17, 17*a*, respectively, and extend in a generally radially-outward direction through the tip portion of core 12. Passageways 21 and 21*a* merge upon entering nozzle 26 in shroud element 16, as shown in FIG. 2. The coolant flow discharge emerges from nozzle 26 and is directed toward turbine housing or casing 19. Cutaway portion 27 of each shroud element 16 forms an extension of the diverging portion 24 of nozzle 26 of the adjacent nozzle on the immediatelypreceding bucket. The structural interrelation between nozzle 26 and its extension 27 becomes manifest in considering any two abutting shroud elements 16. The positional relationships between nozzle 26 and cutaway portion 27 of shroud element 16 relative to turbine bucket 10 are illustrated in FIG. 3**.

Figure 2:
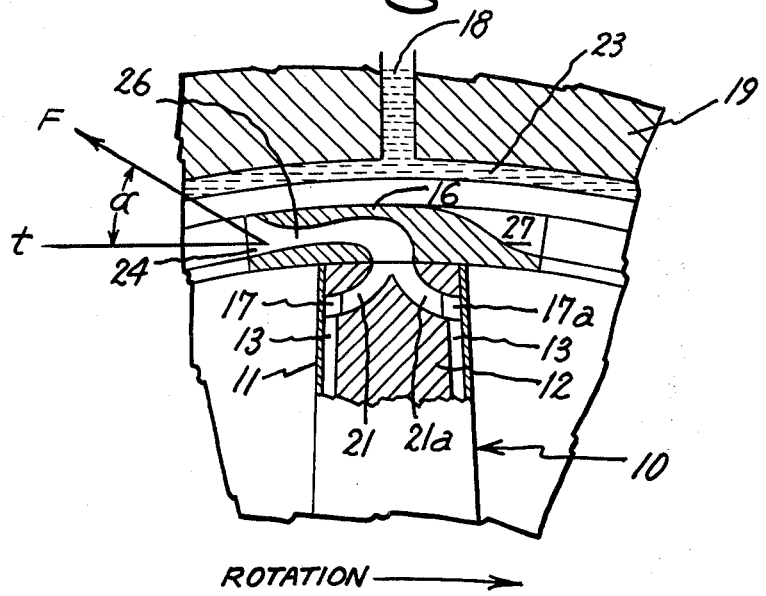
FIG. 2 is a sectional view taken along line 2—2 of FIG. 1.
Figure 3:
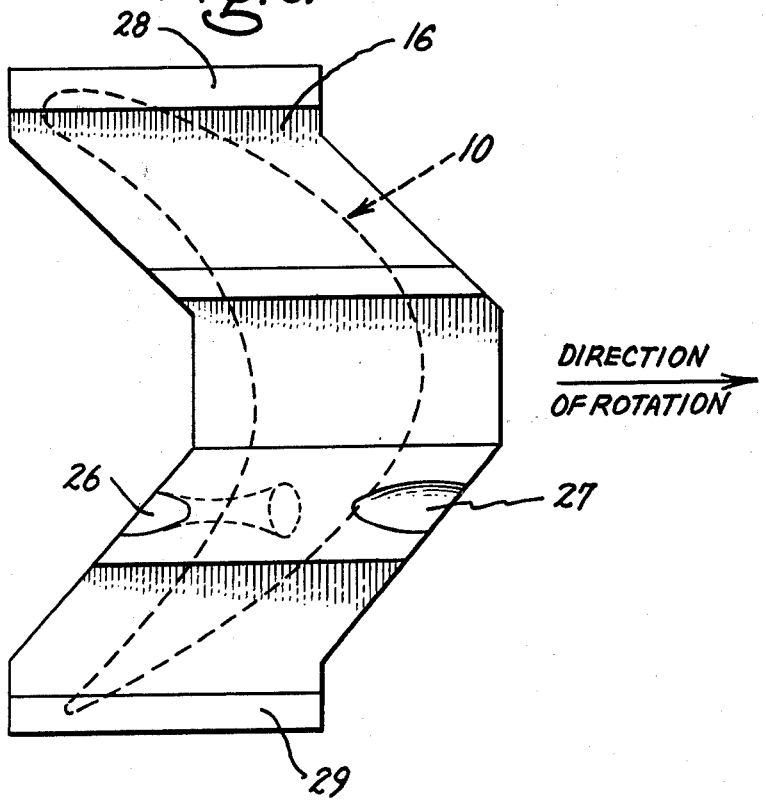
FIG. 3 is a view directed radially-inward showing the interrelationship between a shroud segment and the turbine bucket connected thereto.

As evident in FIG. 2, heated coolant (gas or vapor and excess liquid coolant) discharged from manifolds 17, 17*a* passes through passageways 21, 21*a* and convergent-divergent nozzle 26 toward the inner surface of turbine housing 19. Combined centrifugal forces due to rotation of the turbine rotor and shear forces due to rotational velocity of gases between housing 19 and shroud 16 tend to spread a film of liquid coolant 23 over the entire periphery of a portion of the inner surface of turbine housing 19. Liquid coolant tending to collect at the bottom of housing 19 may be removed therefrom to prevent pooling of the coolant at that location.

With reference to FIG. 1, coolant streams conducted through passages 8 and 9 (and a similar passage, not shown, on the opposite side of the bucket) traverse shroud element 16 and serve both to cool labyrinth seals 28 and 29, respectively, and to enhance their sealing capability. A small purge of coolant passes into the gas stream via each seal, thereby ensuring separation of the hot working fluid from the liquid coolant so as to prevent coolant vapor from diluting and cooling the working fluid or gas. The relative positions of labyrinth seals 28 and 29 are shown in FIG. 3.

Since the direction of the discharge coolant stream is rearward relative to the direction of rotation of bucket 10, the effective reaction force F, shown in FIG. 2 acting at angle $\alpha$ to the tangent line t, provides two useful force components. Specifically, F cos $\alpha$ represents useful torque and F sin $\alpha$ reduces centrifugal stress on bucket 10.

In the exemplary construction shown in FIG. 1, the root end of core 12 comprises a number of tines 31. Rim 32 of turbine disk 33 includes radial grooves 34 machined therein to various depths and having widths matching the different lengths and widths of bucket tines 31 such that the tines fit snuggly into grooves 34 in an interlocking relationship.

Ribs 36 between grooves 34 provide area for attachment thereto of platform element 37 having cooling channels 38 in juxtaposition with grooves 34. The separating walls 39 between cooling channels 38 are dimensioned to coincide with the width of ribs 36, when in juxtaposition therewith.

Cooling liquid (usually water) is sprayed onto disk 33 at low pressure in a generally radially-outward direction from nozzles (not shown herein, but preferably located on each side of disk 33). The coolant thereupon moves into gutters 41, 41*a* defined in part by downwardly-extending lip portions 42, 42*a*. The cooling liquid accumulated in gutters 41, 41*a* cools the disk portions with which it comes into contact and is retained in the gutters until it has been accelerated to the prevailing disk rim velocity, at which time it passes radially outward through passageways 43, 43*a* to the underside of platform 37 where it enters slots 13, 8 and 9 via a metering system (not shown). In transit, the coolant passes along, and thereby cools, the undersurface of platform element 37.

As the cooling liquid moves through the cooling channels of any given bucket, a portion of the coolant is converted to the vapor state as it absorbs heat from skin 11 and core 12 of the bucket. At the outer ends of cooling channels 13, the generated vapor and the remaining liquid pass into manifolds 17 and 17*a* (shown in FIG. 2) and exit from the manifold system onto the inner surface of housing 19 to generate liquid film 23. It should be noted that film 23 is retained axially by damming between a pair of circular seals 44 on turbine housing 19.

The gaseous shear forces between rotating shroud 16 and turbine housing 19, resulting from rotation of the turbine rotor, impart an angular velocity to liquid coolant film 23 which causes the film to be held against the housing by centrifugal force. Thus in order for liquid film 23 to be maintained between maximum and minimum thickness limits about the inner periphery of turbine housing 19 between seals 44, the coolant liquid must be drawn off in the vicinity of the bottom of turbine housing 19 at a rate fast enough to prevent the film from becoming so thick that the gap between housing 19 and shroud 16 becomes flooded and causes high frictional losses, but not so fast as to allow any circumferential discontinuity (i.e., zero thickness) to occur in the film. In addition, the gaseous shear forces must induce coolant film velocities on housing 19 such that resulting centrifugal forces on the film will completely counteract the gravitational forces. These thickness limits may be computed from the static pressure drop across liquid film 23. The static pressure drop across film 23 may be determined according to the difference in pressure measured between a first static pressure sensor, such as an electronic pressure transducer 46 situated in a radial passageway 18 located at the uppermost portion of the inner surface of turbine housing 19 between circumferential seals 44, and a second static pressure sensor, such as an electronic pressure transducer 47 situated in an axial passageway 48 through one of seals 44 substantially in the same radial plane as passageway 18 and opening into the region between seals 44 radially-inward of liquid film 23. Output signals from transducers 46 and 47 are provided through leads 53 and 54, respectively. Since film 23 typically is at minimum thickness in the vicinity of the top of housing 19 and at maximum thickness in the vicinity of the bottom of housing 19, a separate set of transducers may conveniently be situated at each of these locations so as to monitor both the maximum and minimum thicknesses of film 23.

Figure 4:
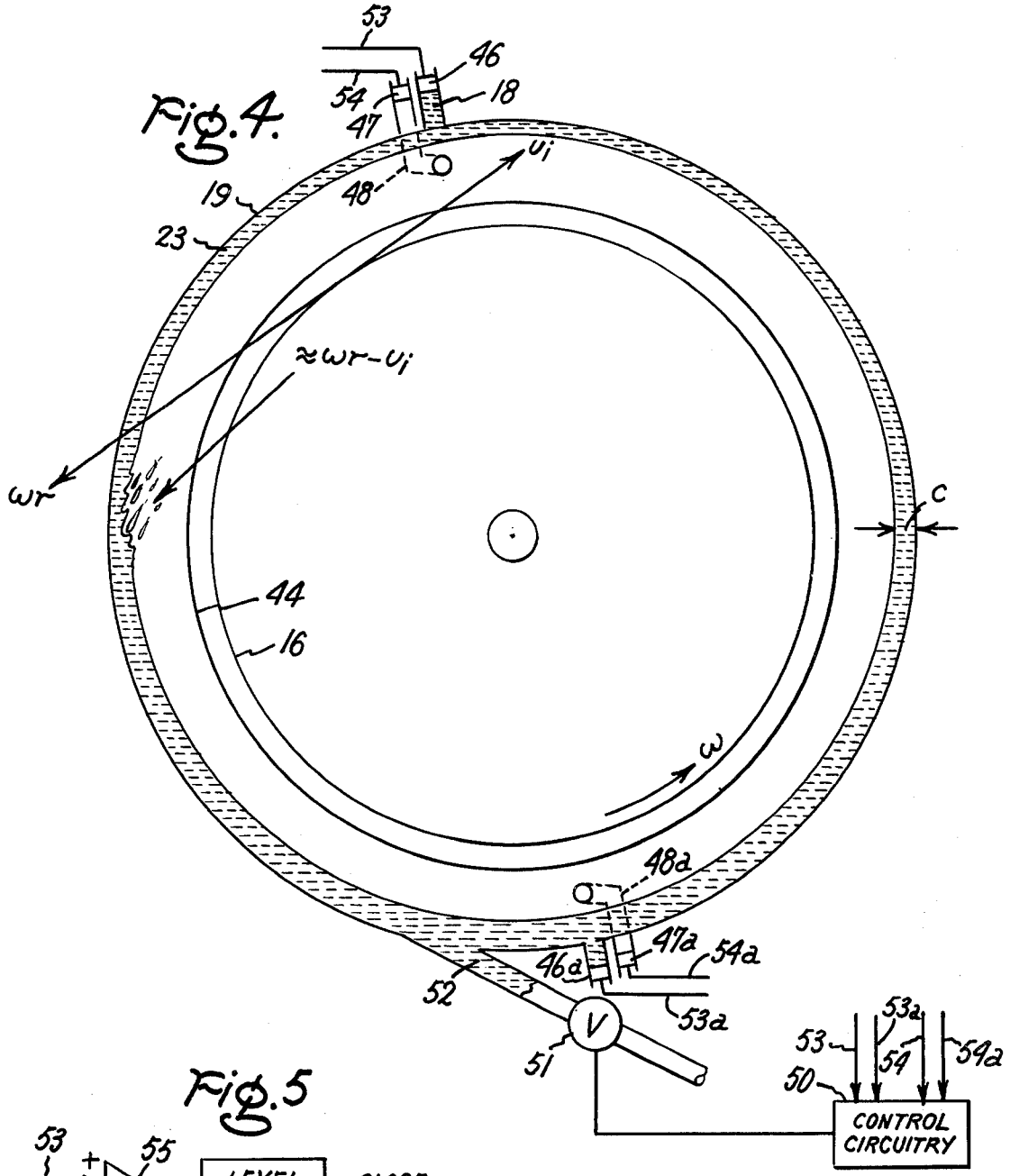
FIG. 4 is a schematic diagram illustrative of the system for maintaining, at a thickness between maximum and minimum limits, a film of liquid coolant around the entire periphery of a portion of the turbine housing inner surface.

In FIG. 4, the apparatus employed to maintain a uniform optimum liquid coolant film thickness on the inner surface of housing 19 is illustrated schematically. The overall turbine shroud 16 is illustrated as rotating counterclockwise at an angular velocity $\omega$ within turbine housing 19. Pressure transducers 46 and 47, situated in passageways 18 and 48, respectively, are shown supplying electronic signals, as through electrical leads 53 and 54, respectively, to control circuitry 50, which thereby senses pressure across film 23 preferably at the location in the vicinity of the top of housing 19 where film thickness is at a minimum. Similarly, pressure transducers 46*a* and 47*a*, situated in passageways 18*a* and 48*a*, respectively, may supply electronic signals through leads 53*a* and 54*a*, respectively, to control circuitry 50 which thereupon senses pressure across film 23 preferably at the location in the vicinity of the bottom of housing 19 where film thickness is at a maximum. The output of control circuitry 50 controls a solenoid-operated valve 51 which regulates the rate at which liquid coolant exits from the gap between housing 19 and shroud 16 through an outlet passageway 52 in the vicinity of the lowermost portion of turbine housing 19.

The thickness of liquid coolant film 23 is at a maximum in the vicinity of the lowermost portion of turbine housing 19 and at a minimum in the vicinity of the uppermost portion of the turbine housing due to the pull of gravity on the liquid. Because of the counterclockwise rotation of the turbine rotor, however, frictional drag tends to displace, counterclockwise, these maximum and minimum thickness locations from the lowermost and uppermost locations, respectively, within the turbine housing, by a substantial amount. Pressure sensors 46 and 46a are preferably located at these points, which conveniently are substantially diametrically opposite each other, and sensors 47 and 47a are preferably located along a common diametrical plane therewith.

Figure 5:
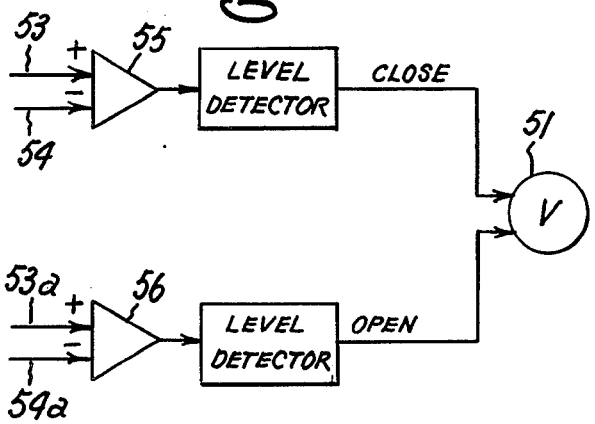
FIG. 5 is a schematic diagram of the control circuitry illustrated in FIG. 4.

The circuit of FIG. 5 illustrates one way in which valve 51 may be controlled to maintain the desired thickness of liquid film 23 illustrated in FIG. 4. Thus an upper film differential amplifier 55 produces an output signal determined by the pressure difference sensed by transducers 46 and 47, while a lower film differential amplifier 56 produces an output signal determined by the pressure difference sensed by transducers 46a and 47a. The output of amplifier 55 is compared to a threshold potential in a level detector 57 and, if the output voltage of amplifier 55 falls below a predetermined level, a signal tending to close valve 51 is supplied to the valve. Similarly, the output of amplifier 56 is compared to a threshold potential in a level detector 58 and, if the output voltage of amplifier 56 exceeds a predetermined level, a signal tending to open valve 51 is supplied to the valve. The output signal from each of the level detectors is variable in amplitude in accordance with the amount that the input signal thereto deviates from the respective predetermined threshold potential.

Figure 6:
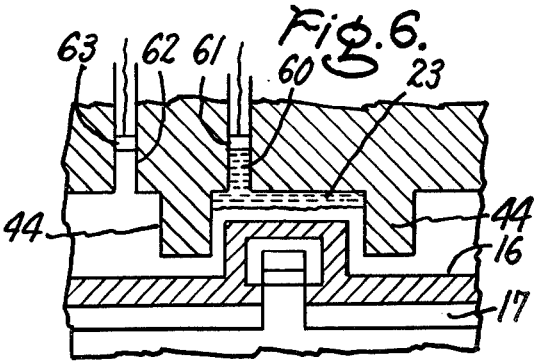
FIG. 6 is a view of a portion of the apparatus shown in FIG. 1, employing alternative means for sensing pressure.

In an alternative embodiment of the invention, differential static pressure may be measured between a tap location on the turbine housing between circumferential labyrinth seals 44 and one located axially outside circumferential seals 44. This is illustrated in FIG. 6, wherein a tap 60 in housing 19 between circumferential seals 44 contains a pressure sensor 61 therein, while a second tap 62 in housing 19 axially outside of the region bounded by circumferential seals 44 contains a pressure sensor 63 therein. Taps 60 and 61 are preferably situated in a common radial plane. Pressure difference signals produced by sensors 61 and 63 are thereby dependent on any film thickness difference between these two sensor locations plus the pressure differential across seals 44 located therebetween. These transducers are operable with control circuitry of the type shown in FIG. 5 and in a manner similar to that described in conjunction with FIG. 5. In either embodiment, commutation of electronic pressure signals is unnecessary since no pressure transducer need be located on a rotating portion of the turbine. Other known methods of obtaining the pressure information of interest may, alternatively, be employed.

In determining the criteria necessary to maintain an appropriate thickness of water film on the inside surface of turbine housing 19, assume that the gas shear stress $\tau_g$ drives a water film 23 of variable thickness c, shown in FIG. 4, at a radially-inner surface velocity $u_o$. Shear stress $\tau_w$ in water film 23 is equal to the shear stress in the gas. Both the gas flow and water film flow may be assumed turbulent, so that the water film shear stress at the surface of film 23 may be determined from the equation for fluid friction on a flat plate, expressed as $$\tau_w \approx 2 \times 10^{-3} \times \tfrac{1}{2}\rho u_o^2$$

at high Reynolds numbers, where $\rho$ is the mass density of water. Similarly, the gas shear at the water film-gas interface may be determined from the equation for frictional flow between a rotating cylinder and a coaxial, stationary cylinder, expressed as $$\tau_g \approx 6.3 \times 10^{-4}\rho_g U_g^2$$

at high Reynolds numbers, where $\rho_g$ is the mass density of the gas and is conventionally determinable by dividing the weight density of the gas (i.e., weight/unit volume) by the acceleration of gravity at a particular gas volume flow rate and temperature, and where $U_g$ is the gas speed at the rotor surface and is essentially equal to the rotor speed.

At $U_g$ = 1570 ft/sec rotor surface speed, and $\rho_g$ = (0.22/32.2) (lb. sec$^2$/ft$^4$) (at 14 ft$^3$/min flow and 2000° F. temperature), $$\tau_g \approx 10.8 \text{ lb/ft}^2$$

For water, $\rho$ = (62.4/32.2) (lb sec$^2$/ft$^4$). Since $$u_o \approx \sqrt{\tau_w}/10^{-3}\rho$$

and since $\tau_w = \tau_g$, $$u_o \approx 74 \text{ ft/sec.}$$

From the momentum equation in the radial direction, the differential pressure in water may be expressed as $$dp = \rho(u^2/r)\,dr$$

where u is the water velocity and r is any radius of curvature from the center of the rotor. Thus.

$$(dp/dr) = \rho(u^2/r).$$

Assuming an approximately linear velocity distribution in the water, $$u \approx u_o(y/c)$$

where c is water film thickness and y is a radially-inward distance from the outermost water film surface, and letting R be the radius of curvature of the turbine housing inner surface, the pressure differential sensed across the water film may be expressed as $$\Delta p = \rho\frac{cu_o^2}{R}\int_0^l\left(\frac{y}{c}\right)^2\frac{dy}{c} = \frac{1}{3}\rho\frac{cu_o^2}{R}$$

which must exceed the gravitational force $\rho cg$ to keep the water film in contact with the turbine housing around the entire inner periphery of the housing. Therefore $$\tfrac{1}{3}\rho c u_o^2/R > \rho cg, \text{ or}$$

$$u_o > \sqrt{3Rg}.$$

For a typical radius of 4 feet, $$u_o > \sqrt{3} \times 4 \times 32.2 \approx 20 \text{ ft/sec.}$$

Since this minimum value of $u_o$ is well within the 74 ft/sec water film radially-inner surface velocity which the turbine is capable of providing, it is clear that the gas shear forces can drive the water film at sufficient velocity for it to remain attached to the turbine housing.

It should be noted that the erosion forces due to water slung off the turbine rim can impact the housing obliquely at a velocity $U_g$. The normal pressure produced by a steady stream of water is $$P_t = \frac{1}{2}\rho u_f^2$$

where $u_f$ is the velocity of the steady stream. However, if the stream becomes broken up into droplets, pressure produced on the turbine housing as a result of the slamming by the droplets may be expressed, according to F. J. Heymann in "High Speed Impact Between a Liquid Drop and a Solid Surface", *Journal of Applied Physics* 40, pages 5113–5122 (December, 1969), as $$P_t = 3\rho a u_i$$

where a = 5000 ft/sec speed of sound in the liquid. Thus for both steady stream velocity $u_f$ and individual droplet velocity $u_i$ equal to a typical value of 1600 ft/sec, pressure on the housing due to the steady stream is 17,200 lb/in$^2$ while pressure on the housing due to the individual droplets is 323,000 lb/in$^2$. Hence the need to protect the housing from erosion due to impact of the individual droplets is apparent. This protection is accomplished by maintaining a continuous film of water around the inner circumference of the housing to absorb much of the energy in the individual droplets upon impact on the film. Note that the droplet velocity is approximately $\omega r - u_i$, where $\omega$ is the turbine rotor angular velocity.

The foregoing describes a method and apparatus for minimizing erosion of gas turbine walls. The invention ensures that a major portion of the kinetic energy imparted to liquid coolant droplets by rotational velocity of gas turbine bucket shroud elements is absorbed prior to the droplets striking the inner surface of the turbine housing. This is accomplished by providing a circumferentially-continuous liquid coating over the inside surface of the gas turbine housing.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. A method of reducing erosion of the inner surface of a gas turbine housing due to slamming of droplets of liquid coolant thereagainst, comprising: coating the surface over a defined region of the housing, said defined region extending circumferentially around said housing and having a limited dimension in the direction of the axis of rotation of said turbine with a circumferentially-continuous film of liquid coolant to absorb at least a portion of the kinetic energy of said droplets, and controllably maintaining said film between predetermined thickness limits substantially throughout normal operation of said gas turbine by detecting the film thickness at two spaced locations and drawing off liquid coolant from said region in response to detecting a predetermined difference in the film thickness at said two spaced locations.

2. The method of claim 1 wherein the step of coating the surface with a circumferentially-continuous film of liquid coolant comprises retaining droplets of said liquid coolant over the entire inner surface of said region, and drawing off excess coolant tending to collect in the vicinity of a low point along said region.

3. The method of claim 2 including the step of regulating the rate at which liquid coolant is drawn off so as to maintain said film in the vicinity of said low point at less than a predetermined thickness.

4. The method of claim 3 wherein the step of regulating the rate at which liquid coolant is drawn off comprises the step of determining static pressure difference between a first location in said turbine housing at the radially-outermost surface of said film and a second location in said turbine housing in a gas-containing region between shrouds on buckets of said turbine, and adjusting the rate at which said liquid coolant is drawn off so as to maintain said static pressure difference within a predetermined range.

5. The method of claim 4 wherein said step of determining static pressure difference is performed at two, substantially diametrically-opposite and diametrically-coplanar locations on said turbine housing.

6. In a gas turbine having a rotor disk mounted on a shaft rotatably supported on a housing, said rotor disk extending substantially perpendicular to the axis of said shaft and having turbine buckets and platform means affixed to the outer rim thereof, said buckets receiving a driving force from a hot motive fluid confined within said housing and moving in a direction generally parallel to the axis of said shaft, said turbine including means for introducing liquid coolant into distribution paths by which said coolant traverses surface area of said rim and said platform means, passes into cooling channels in said buckets, and exits from said channels in a radially-outward direction, means for suppressing erosion of said turbine housing due to impact of droplets of said coolant thereon, comprising: an outlet in said turbine housing to permit escape of liquid coolant from the interior of said turbine, and valve means in said outlet responsive to radial static pressure differential measured substantially in two different radial planes on the housing and controlling rate of escape of liquid coolant so as to maintain a liquid coolant film of thickness within maximum and minimum limits about the inner surface of said turbine housing.

7. The apparatus of claim 6 including pressure sensing means in said turbine housing sensing static pressure differential across said film, and means coupling said pressure sensing means to said valve means.

8. The apparatus of claim 7 wherein said pressure sensing means comprises a first transducer producing an electrical signal in accordance with static pressure sensed at the radially-outermost surface of said film, and a second transducer producing an electrical signal in accordance with static pressure sensed in a gas-containing region radially between said turbine disk and said liquid film.

* * * * *